US005269495A

United States Patent [19]

Döbbeling

[11] Patent Number: 5,269,495

[45] Date of Patent: Dec. 14, 1993

[54] HIGH-PRESSURE ATOMIZING NOZZLE

[75] Inventor: Klaus Döbbeling, Nussbaumen, Switzerland

[73] Assignee: Asea Brown Boveri Ltd., Baden, Switzerland

[21] Appl. No.: 805,660

[22] Filed: Dec. 12, 1991

[30] Foreign Application Priority Data

Jan. 23, 1991 [EP] European Pat. Off. ..... 9100787.0

[51] Int. Cl.[5] ..... B05B 1/02

[52] U.S. Cl. ..... 239/590.3; 239/590

[58] Field of Search ..... 239/590, 590.3, 590.5, 239/461

[56] References Cited

U.S. PATENT DOCUMENTS

| | | | |
|---|---|---|---|
| 2,369,357 | 2/1945 | Kunz | 239/590.3 |
| 2,681,829 | 6/1954 | Wahlin | 239/590.3 |
| 3,974,966 | 8/1976 | Watkins | 239/590.3 |
| 4,930,701 | 6/1990 | Porter et al. | 239/590 |

FOREIGN PATENT DOCUMENTS

| | | | |
|---|---|---|---|
| 627972 | 3/1936 | Fed. Rep. of Germany . | |
| 1403676 | 5/1965 | France . | |
| 1570787 | 6/1990 | U.S.S.R. | 239/590.5 |
| 717562 | 10/1954 | United Kingdom . | |

OTHER PUBLICATIONS

"Lueger-Lexicon der Energietechnik und Kraftmanshinen" 1965, DVA, Stuttgart, p. 600.

Patent Abstracts of Japan vol. 14, No. 57 (C-684) (4000) Feb. 2, 1990 & JP-A-01 284 351 (IKEUCHI) Nov. 15, 1989.

*Primary Examiner*—Andres Kashnikow
*Assistant Examiner*—Lesley D. Morris
*Attorney, Agent, or Firm*—Oblon, Spivak, McClelland, Maier & Neustadt

[57] ABSTRACT

For the optimum atomization of liquid materials, a high-pressure atomizing nozzle is proposed with a nozzle body (1) in which is formed a turbulence chamber (11) which is connected to an external space via a nozzle orifice (4) and which has supply ducts (8) for the fluid to be atomized, through which ducts the fluid mentioned can be supplied under pressure. The cross-sectional areas of the supply ducts (8) entering the turbulence chamber (11) are larger by a factor of between 2 and 10 than the cross-sectional area of the nozzle orifice (4). In this way, part of the nozzle upstream pressure available is used to generate high levels of turbulence in the fluid to be atomized. The turbulence generation is achieved by means of an abrupt expansion (Carnot diffuser) in the turbulence chamber located before the actual nozzle orifice. The resulting droplet spray exhibits small angles of spread and very small droplet sizes (in the case of the atomization of water, ≦20 microns at upstream pressures ≧150 bar).

8 Claims, 4 Drawing Sheets

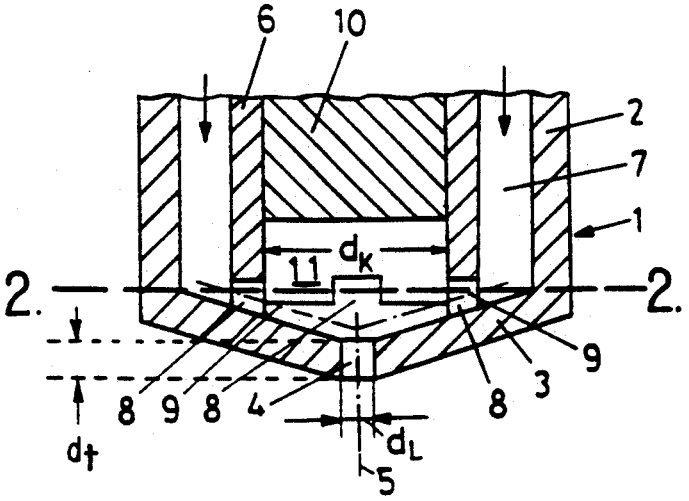
FIG.1
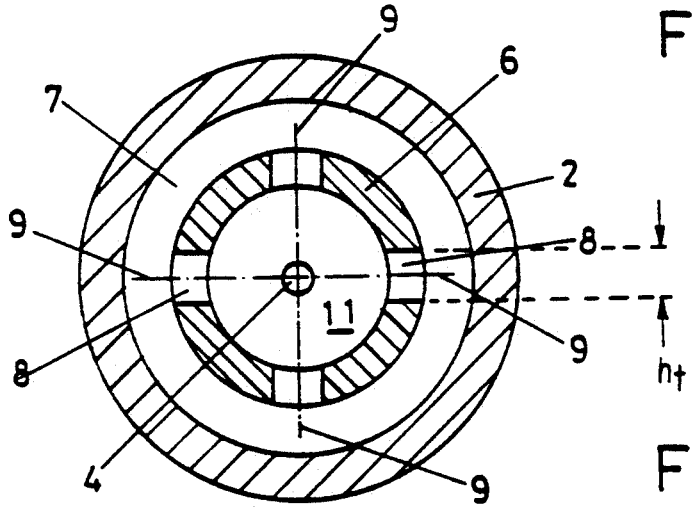
FIG.2
FIG.3
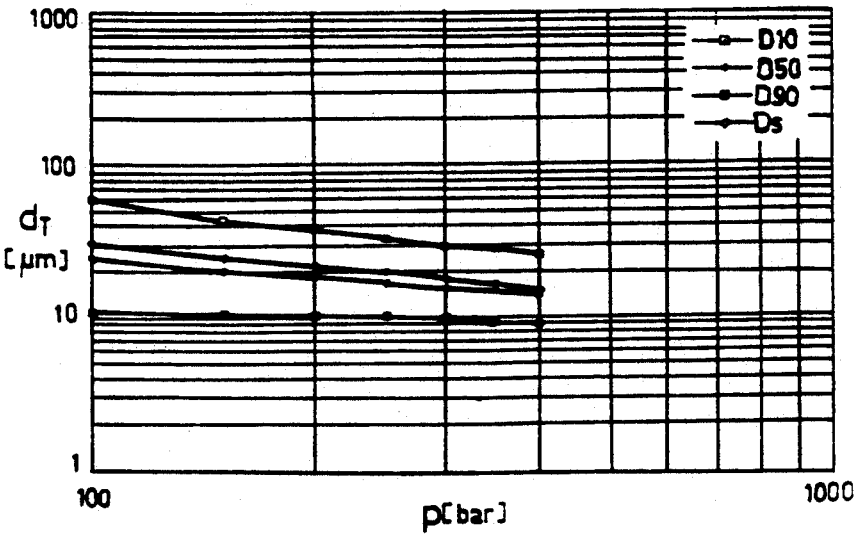

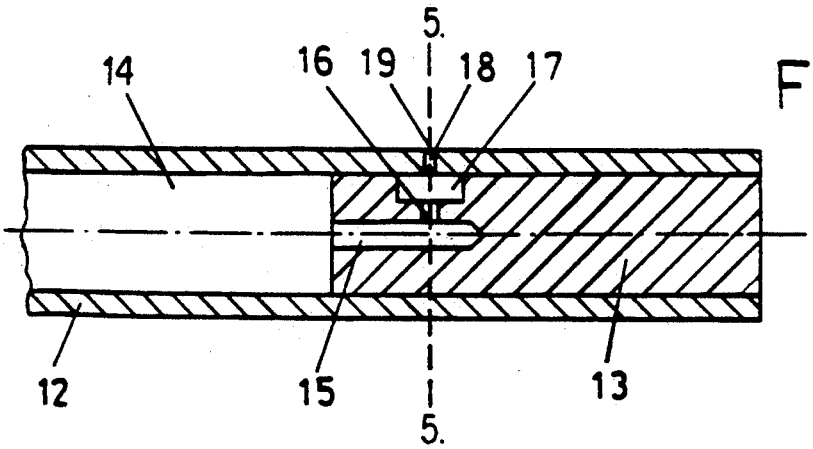
FIG.4
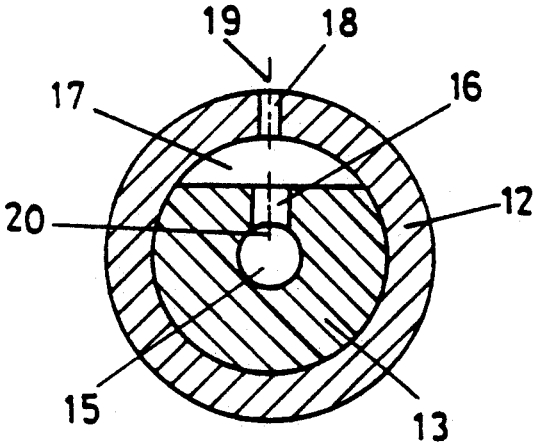
FIG.5
FIG.6
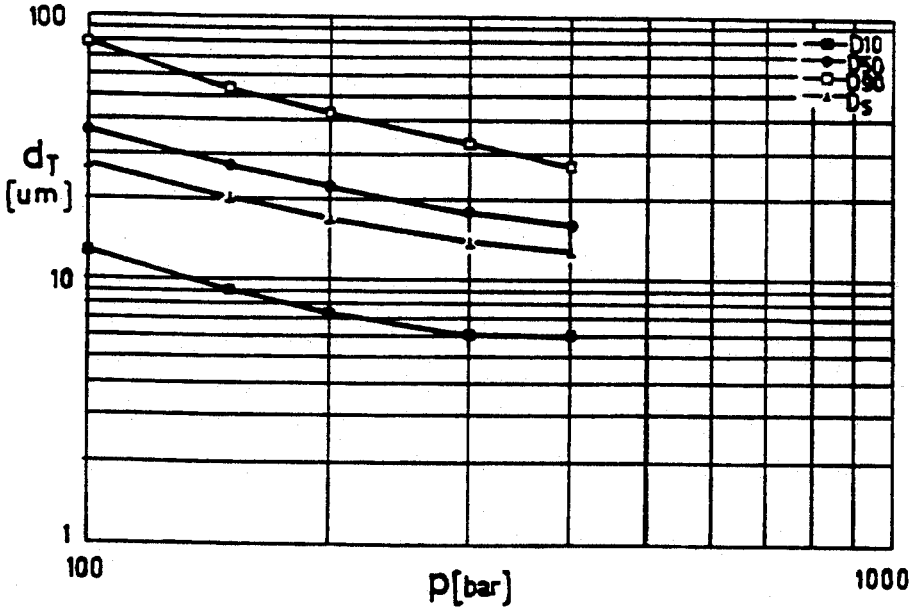

HIGH-PRESSURE ATOMIZING NOZZLE

BACKGROUND OF THE INVENTION

1. Field of the Invention

The invention concerns a high-pressure atomizing nozzle, including a nozzle body in which is formed a turbulence chamber, which is connected to an external space via at least one nozzle orifice and which has at least one supply duct for the fluid to be atomized, through which supply duct the fluid mentioned can be supplied under pressure.

The invention makes reference to a state of the art which is given under the title "Zerstäuberbrenner (atomizer burner)" in the book "LUEGER—LEXIKON DER ENERGIETECHNIK UND KRAFTMASCHINEN", DVA Stuttgart 1965, p. 600.

2. Discussion of Background

In atomizer burners, the oil provided for combustion is mechanically finely distributed, i.e. it is broken down into small droplets of some 10 to 400 micron diameter (oil mist). The droplets, mixed with combustion air, evaporate and burn in the flame. In addition to atomizer types such as injection and swirl atomizers, so-called pressure atomizers are used. In these, oil is supplied under high pressure by a delivery pump to an atomizer nozzle which is fastened to a nozzle body. The oil enters a swirl chamber in substantially tangentially extending slots or ducts and leaves the nozzle via a nozzle orifice. The tangential inlet flow has the effect that the oil particles are given two components of motion, one azimuthal and one axial. The rotation of the fluid in the swirl chamber causes the formation of an air funnel whose apex extends into the swirl chamber. The oil film emerging from the nozzle orifice as a rotating hollow cylinder expands, because of the centrifugal force, into a hollow cone whose edges become subject to unstable vibration and break up into small oil droplets. The atomized oil forms a cone with a larger or smaller included angle.

The low-emission combustion of mineral fuels in modern burners places particular requirements on the atomization; these may be stated as follows:

- the droplets must be very small so that they can evaporate before combustion;
- the included angle (angle of spread) of the oil mist should be small in certain types of burners, particularly in the case of combustion under high pressure (e.g. diesel engine, gas turbine);
- the droplets must have a very high velocity so that they can penetrate far enough into the combustion air stream (even when density is increased by a factor of 5 in, for example, a gas turbine combustion chamber).

Swirl nozzles of known design are less suitable for this purpose because they do not permit small angles of spread.

SUMMARY OF THE INVENTION

Accordingly, one object of this invention is to provide a novel high-pressure atomizing nozzle which is of simple construction, permits very small angles of spread and permits optimum disintegration of the jet even at relatively low pressures.

This object is achieved according to the invention in that the cross-sectional area(s) of the supply duct or ducts entering the turbulence chamber is (are) larger by a factor of between 2 and 10 than the cross-sectional area of the nozzle orifice. In order to atomize water using nozzle orifices of 0.5 mm, approximately four times the nozzle outlet area is a reasonable figure for the turbulence chamber inlet area.

In this way, part of the nozzle upstream pressure available is used to generate a high level of turbulence in the fluid to be atomized. The turbulence generation is achieved by means of a sudden expansion (Carnot diffuser) in the turbulence chamber located before the actual nozzle orifice. The fluid flowing into the turbulence chamber has practically no tangential velocity components imposed on it in the turbulence chamber; it is simply put in a state of strong turbulence excited by shear forces. The inlet flow into the turbulence chamber can take place by means of one or a plurality of supply ducts, preferably extending substantially radially to the nozzle orifice axis, or also axially and coaxially with the nozzle orifice. In the limiting case, the supply duct is an annular gap. This provides, in the fuel jet emerging from the nozzle orifice also—in contrast to known swirl nozzles where the droplets occur due to the disintegration of a thin liquid film downstream of the nozzle orifice—substantially no tangential velocity components which would lead to a conical widening of the fuel. The result is that the fluid jet is made to decompose rapidly because of the turbulence generated before the nozzle orifice. The resulting droplet spray exhibits small angles of spread and very small droplet sizes (in the case of the atomization of water, $\leqq 20$ microns at upstream pressures $\geqq 150$ bar).

Compared with simple orifice nozzles, jet disintegration occurs at substantially lower pressures. Compared with diesel injection nozzles, better atomization quality is obtained because of the turbulence generator located before the injection orifice.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a longitudinal section through a first illustrative example of a high-pressure atomizing nozzle with radial supply flow into the turbulence chamber;

FIG. 2 shows a cross-section through the high-pressure atomizing nozzle of FIG. 1 along the line AA in the latter;

FIG. 3 shows a diagram illustrating the way in which, for the atomization of water, droplet size depends on the pressure of a high-pressure atomizing nozzle as shown in FIGS. 1 and 2;

FIG. 4 shows an illustrative example of a high-pressure atomizing nozzle with axial supply flow, in longitudinal section;

FIG. 5 shows a cross-section through the high-pressure atomizing nozzle of FIG. 4 along the line BB in the latter;

FIG. 6 shows a diagram illustrating the way in which, for the atomization of water, the droplet size depends on the pressure of a high-pressure atomizing nozzle as shown in FIGS. 4 and 5.

DESCRIPTION OF THE PREFERRED EMBODIMENTS

Figure 2A:
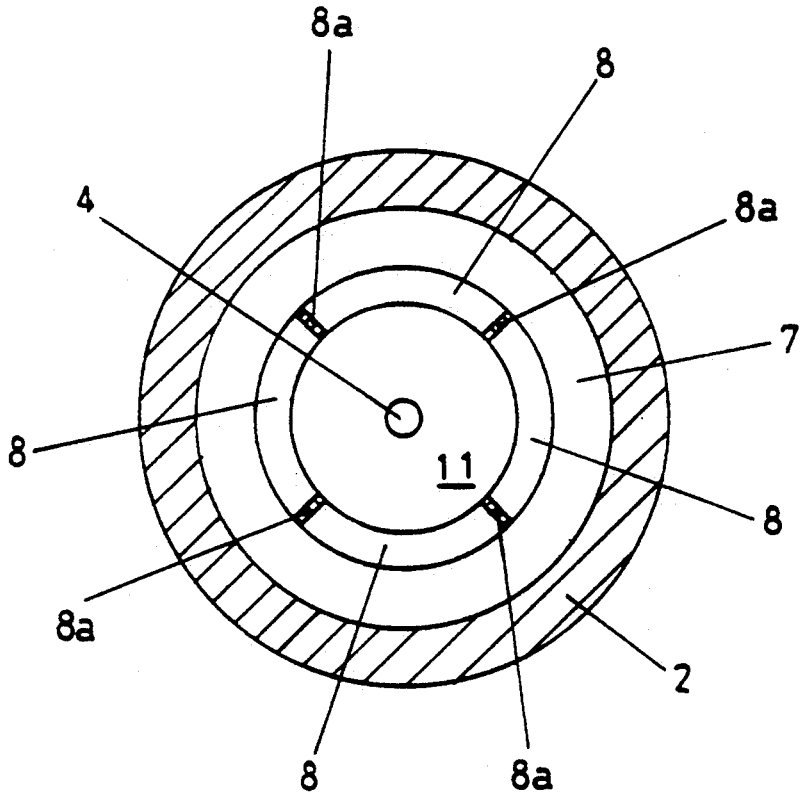
FIG. 2*a* shows a cross-section through a modification of FIG. 2 with supply ducts which are designed as a gap.

Referring now to the drawings, wherein like reference numerals designate identical, or corresponding parts throughout the several views, the high-pressure atomizing nozzle of FIG. 1 includes a nozzle body 1, consisting of a tube 2 which is closed towards the bottom by a conical cover 3. In the centre of the cover 3, there is a nozzle orifice 4 whose longitudinal axis is designated by 5. Inserted in the tube 2, there is a second tube 6 which extends as far as the cover 3 and is in contact with the latter. The annular space 7 between the tubes 2 and 6 is used for the supply of fluid (water, liquid fuel). The end of the tube 6 in contact with the cover 3 is provided with four radial slots 8 whose longitudinal axes are designated by 9. The four longitudinal axes 9 of the slots 8 intersect on the longitudinal axis 5 of the nozzle orifice 4. A filler piece 10 is pushed into the inside of the second tube 6 and is fastened into it. This filler piece 10 is at a distance from the upper edge of the slot 8. In this way, a space 11 is formed between the cover 3 and the filler piece 10 and this is used as the turbulence chamber.

The fluid to be atomized enters the turbulence chamber 11 under pressure via the annular space 7 and through the slots 8. As shown in FIG. 1, the length of slot 8 between the inner cylinder 6 and the conical end portion of nozzle body 1 is less than the width of annular space 7 formed between the inner tube 6 and the outer tube 2 of the nozzle body 1. The jets—four in the case of the example—enter the turbulence chamber 11 substantially radially and generate a very high turbulence level because of the intensive shear, because of their deflection into the axial direction and because of the impingement of the jets on one another. This high turbulence level does not decay in the short distance before emergence from the nozzle. Because of the turbulence generated before the nozzle orifice 4, the liquid jet is brought to rapid disintegration in the external space (after leaving the nozzle orifice 4) so that angles of spread of 20° and less occur in the external space. The cross-sections of the nozzle and the slots 8 follow from the desired throughput (as a function of the upstream pressure), allowance being made for Reynolds numbers in the nozzle orifice 4 and the slots 8 which are sufficiently high.

The diagram shown in FIG. 3 illustrates the way in which the droplet diameter $d_T$ depends on the upstream pressure p for various limiting diameters of the droplet mass distribution $Q_3$, measured at a distance of approximately 200 mm from the nozzle. $D_X$ designates, for example, the limiting diameter for which X% by weight of all the particles is less than this diameter. $D_S$ designates the Sauter diameter. The Sauter diameter $D_S$ is a well-known measurement for the droplet size distribution as an integration algorithm over all droplets in the area outside the nozzle. The high-pressure atomizing nozzle on which the diagram is based had water flowing through it and had the following main characteristics (see FIG. 1):

$d_L$=0.3 mm, $d_t$=0.5 mm, $h_t$=0.3 mm, $d_K$=2 mm where $d_L$ represents the diameter of the nozzle orifice, $d_t$ represents the length of the nozzle orifice (and also the wall thickness of cover 3) $d_K$ represents the diameter of chamber 11, $h_t$ represents the diameter of each radial slot 8, and where the volume of chamber 11 is approximately equal to 0.4 cubic millimeters.

The high-pressure atomizing nozzle according to the invention can also, as a departure from the illustrative examples shown, be provided with fewer or more slots 8 or the slots can, as is shown in FIG. 2a, extend over almost the complete periphery of the inner tube 6. The individual supply ducts 8 are then only separated from one another by narrow protrusions 8a, which are used to maintain the distance of the tube 6 from the cover 3. In the limiting case of an infinitely large number of slots, an annular gap appears as the supply duct into the turbulence chamber 11.

Even a single radially extending slot 8 achieves the desired effect of extremely high turbulence formation in the turbulence chamber 11.

Figure 2B:
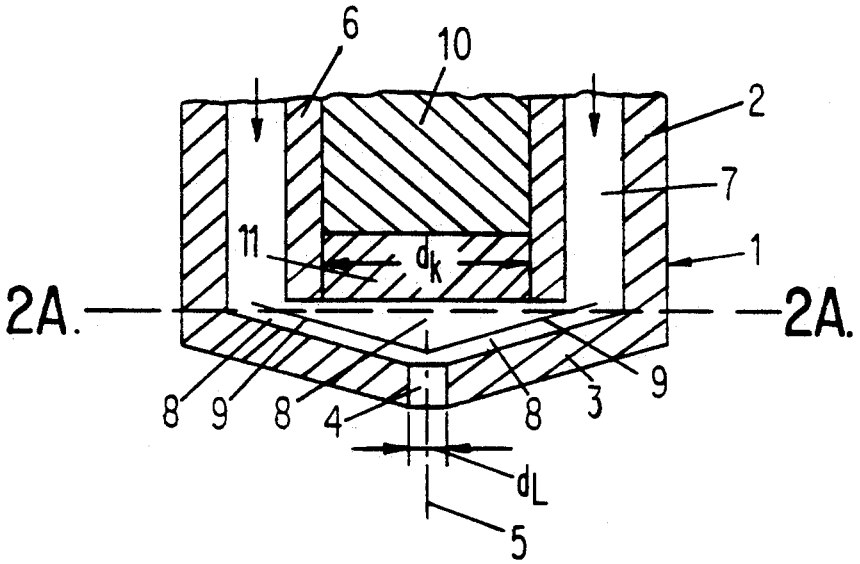
FIG. 2*b* shows another embodiment of the present invention wherein the slot formed in the inner cylinder is made to be continuous around the entire circumference such that an annular space exists between the end portion of the inner cylinder and the conical end portion of the nozzle body.

Instead of a radial inlet flow into the turbulence chamber 11, as shown in FIGS. 1 and 2, the desired turbulence can be achieved by axial supply flow, as shown in the embodiment of FIGS. 4 and 5. In this case, a metallic insert 13 is soldered/brazed into a tube 12 and seals off this tube towards the right. The inside 14 of the tube is used for the supply of fuel. Machined into the insert 13, there is a blind hole 15 which is connected to a recess 17, which functions as the turbulence chamber in this embodiment, shaped like a sector of a cylinder, in the metallic insert 13 by means of a radially extending hole 16. This recess 17 forms the turbulence chamber and corresponds to the space 11 of FIG. 1 while the hole 16 corresponds to the slots 8 in FIG. 1. The tube 12 is supplied with a nozzle orifice 18 coaxial with the hole 16. The longitudinal axis of the nozzle orifice 18 is designated by 19 and the longitudinal axis of the hole 16 is designated by 20. The two axes 19 and 20 are coincident. Although, in the embodiment of a high-pressure atomizing nozzle as shown in FIGS. 4 and 5, no deflection of the fluid jet flowing into the turbulence chamber 17 takes place, the flow into the "cavity" (turbulence chamber 17) alone generates a sufficiently high level of turbulence, which continues in the nozzle orifice 18 and causes the fluid to disintegrate in the external space. Here again, angles of spread of the droplet spray of 20° and less in the external space can be achieved.

The diagram of FIG. 6 illustrates the way in which the droplet radius $d_T$ depends on the upstream pressure p for various limiting diameters $D_X$ and also provides, when compared with FIG. 3, an impression of the relatively small extent to which the droplet radius $d_T$ depends on the nozzle diameter $d_L$. As in the diagram of FIG. 3, $D_X$ designates the limiting diameter for which X% by weight of all the particles are less than this diameter. $D_S$ designates the Sauter diameter. The high-pressure atomizing nozzle on which the diagram is based had water flowing through it and had the following main characteristics:

| | |
|---|---|
| Diameter of the nozzle orifice $d_L$: | 0.12 mm |
| Length of the nozzle orifice = wall thickness of the tube 12: | 0.35 mm |
| Volume of the turbulence chamber: | approx. 0.4 $mm^3$ |

-continued

| | |
|---|---|
| Diameter of the hole 16: | 0.3 mm |

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high-pressure atomizing nozzle, comprising:

a nozzle body including an outer cylinder extending in a predetermined direction, and an inner cylinder also extending in said predetermined direction and formed inside said outer cylinder so that an annular space exists between the inner and outer cylinders, said nozzle body further including a conical end portion having a nozzle orifice formed therein at an end portion of said inner cylinder facing said conical portion of the nozzle body;

a filler piece formed within said inner cylinder, also having an end facing said conical end portion of the nozzle body, such that a turbulence chamber is formed by said conical end portion of the nozzle body and the end portions of said filler piece and said inner cylinder facing said conical end portion of the nozzle body, wherein said turbulence chamber is in fluid communication with an external environment via said nozzle orifice; and at least one slot formed in the end of said inner cylinder facing said conical portion, said at least one slot having a length in a direction parallel to said predetermined direction which is less than a width of the annular space between said inner and outer cylinders.

2. A high-pressure atomizing nozzle according to claim 1, wherein said end portion of the inner cylinder facing said conical end portion of the nozzle body is in contact with said conical end portion.

3. A high-pressure atomizing nozzle according to claim 1, wherein said at least one slot extends around the entire circumference of said end portion of the inner cylinder such that an annular space exists between said end portion of the inner cylinder and said conical end portion of the nozzle body.

4. A high-pressure atomizing nozzle according to any one of claims 1–3, wherein an axis of said nozzle orifice and an axis of said at least one slot intersect with each other.

5. A high-pressure atomizing nozzle, comprising:

a nozzle body including a hollow cylinder with a cylindrical metallic insert formed therein;

a first hole formed in said metallic insert in an axial direction of said metallic insert;

a turbulence chamber formed in said metallic insert adjacent to a side wall of said hollow cylinder;

a nozzle orifice formed in said side wall of the hollow cylinder so as to be in fluid communication with the turbulence chamber and also in fluid communication with said first hole via a second hole extending perpendicularly to said axial direction, wherein said nozzle orifice and said second hole are longitudinally extending cylindrical spaces having longitudinal axes which coincide with each other.

6. A high-pressure nozzle according to claim 5, wherein said turbulence chamber is formed in the shape of a cylinder section.

7. A high-pressure atomizing nozzle, including a nozzle body in which is formed a turbulence chamber which is connected to an external space via a nozzle orifice and which has at least one supply duct for a fluid to be atomized, through which said at least one supply duct said fluid is supplied under pressure, wherein a cross-sectional area/areas of said at least one supply duct or combined cross-sectional areas of the supply ducts entering the turbulence chamber is/are larger by a factor of between 2 and 10 than the cross-sectional area of the nozzle orifice, wherein the nozzle orifice is designed as a radial hole in the wall of a tube, wherein in said tube a metallic insert is fastened and wherein a recess is formed as the turbulence chamber in said metallic insert in the region of the nozzle orifice, which recess is connected to the internal space of the tube via a first hole extending radially in the metallic insert and a second hole extending axially and connected to the first hole, the axes of the first hole in the metallic insert and the nozzle orifice coinciding with each other.

8. A high-pressure atomizing nozzle as claimed in claim 7, wherein the recess in the insert has the shape of a cylinder which is machined into the insert from the outside.

* * * * *

UNITED STATES PATENT AND TRADEMARK OFFICE

CERTIFICATE OF CORRECTION

PATENT NO. : 5,269,495

DATED : December 14, 1993

INVENTOR(S) : Klaus Dobbeling

It is certified that error appears in the above-indentified patent and that said Letters Patent is hereby corrected as shown below:

On the title page, Item [30],

The Foreign Application Priority number should be:

--91100787.0--

Signed and Sealed this

Thirty-first Day of May, 1994

Bruce Lehman

*Attest:*

BRUCE LEHMAN

*Attesting Officer*

*Commissioner of Patents and Trademarks*